US006053159A

United States Patent [19]

Liu

[11] Patent Number: 6,053,159

[45] Date of Patent: Apr. 25, 2000

[54] TILE CUTTING DEVICE PROVIDED WITH AUXILIARY BASE

[76] Inventor: Yi-Hua Liu, No. 1-21, Ta Hsin Road, Tan Tsu Hsain, Taichung Hsien, Taiwan

[21] Appl. No.: 09/098,379

[22] Filed: Jun. 17, 1998

[51] Int. Cl.[7] ..... B28D 1/24

[52] U.S. Cl. ..... 125/23.02; 225/96.5

[58] Field of Search ..... 225/96, 96.5, 94, 225/104; 125/23.01, 23.02

[56] References Cited

U.S. PATENT DOCUMENTS

| | | | |
|---|---|---|---|
| 4,860,723 | 8/1989 | Fortin | 125/23.01 |
| 5,303,690 | 4/1994 | Ishii | 125/23.01 |
| 5,505,359 | 4/1996 | Joecker, Jr. | 225/96 |
| 5,560,274 | 10/1996 | Turner | 225/96.5 |

*Primary Examiner*—Rinaldi I. Rada
*Assistant Examiner*—Kim Ngoc Tran
*Attorney, Agent, or Firm*—Browdy and Neimark

[57] ABSTRACT

A tile cutting device is composed of a base, two support frames, two guide rods, a slide seat, a cutting tool seat, a cutting tool, and a grip rod. The base is provided at one longitudinal side thereof with an auxiliary base which is detachably fastened therewith such that the upper surface of the auxiliary base is flush with a tile placing surface of the base, and that the auxiliary base gives an added width to the base to accommodate a large tile to be worked on by the tile cutting device. The auxiliary base can be unfastened and kept in the underside of the base.

6 Claims, 3 Drawing Sheets

TILE CUTTING DEVICE PROVIDED WITH AUXILIARY BASE

FIELD OF THE INVENTION

The present invention relates generally to a tile cutting device, and more particularly to a tile cutting device which is provided with an auxiliary base for giving an added width to the base of the tile cutting device.

BACKGROUND OF THE INVENTION

As shown in FIG. 1, a tile cutter 10 of the prior art comprises a rectangular base 11, two support frames 12, two guide rods 13, a slide seat 14, a cutting tool seat 15, a circular cutting tool 16, a press plate 17, and a grip rod 18.

The two support frames 12 are mounted on both longitudinal ends of the base 11. The two guide rods 13 are fastened with the two support frames 12 such that the two guide rods 13 are parallel to each other, and that the slide seat 14 is fastened pivotally with the two guide rods 13. The cutting tool seat 15 is fastened pivotally with the slide seat 14 such that the cutting tool seat 15 is located between the two guide rods 13. The circular cutting tool 16 is fastened pivotally with the bottom of the cutting tool seat 15. The press plate 17 is fastened with the bottom of the cutting tool seat 15 such that the press plate 17 is located behind the circular cutting tool 16. The grip rod 18 is fastened with the cutting tool seat 15 for pushing the cutting tool seat 15 to move along the guide rods 13.

The tile cutter 10 of the prior art is in not effective design in that it has a long base 11 and two long guide rods 13, which complicate the storing and the packaging of the tile cutter 10. In addition, the base 11 has a width which is insufficient to support securely a large tile to be worked on by the tile cutter 10, especially at such time when the cutting line is located away from the center of the large tile.

SUMMARY OF THE INVENTION

It is therefore the primary objective of the present invention to provide a tile cutting device with an auxiliary base for widening the base of the tile cutting device so as to facilitate the cutting of a large tile.

It is another objective of the present invention to provide a tile cutting device with an auxiliary base which does not result in an increase in the packaging volume of the tile cutting device.

In keeping with the principles of the present invention, the foregoing objectives of the present invention are attained by a tile cutting device consisting of a base, two support frames, two guide rods, a slide seat, a cutting tool seat, a cutting tool, a press plate, and a grip rod. The base is provided in one of two longitudinal sides thereof with an auxiliary base which is detachably fastened therewith such that the upper surface of the auxiliary base is flush with a tile placing surface of the base. The auxiliary base can be secured to the underside of the base without resulting in an increase in the total packaging volume of the tile cutting device.

DETAILED DESCRIPTION OF THE INVENTION

Figure 1:
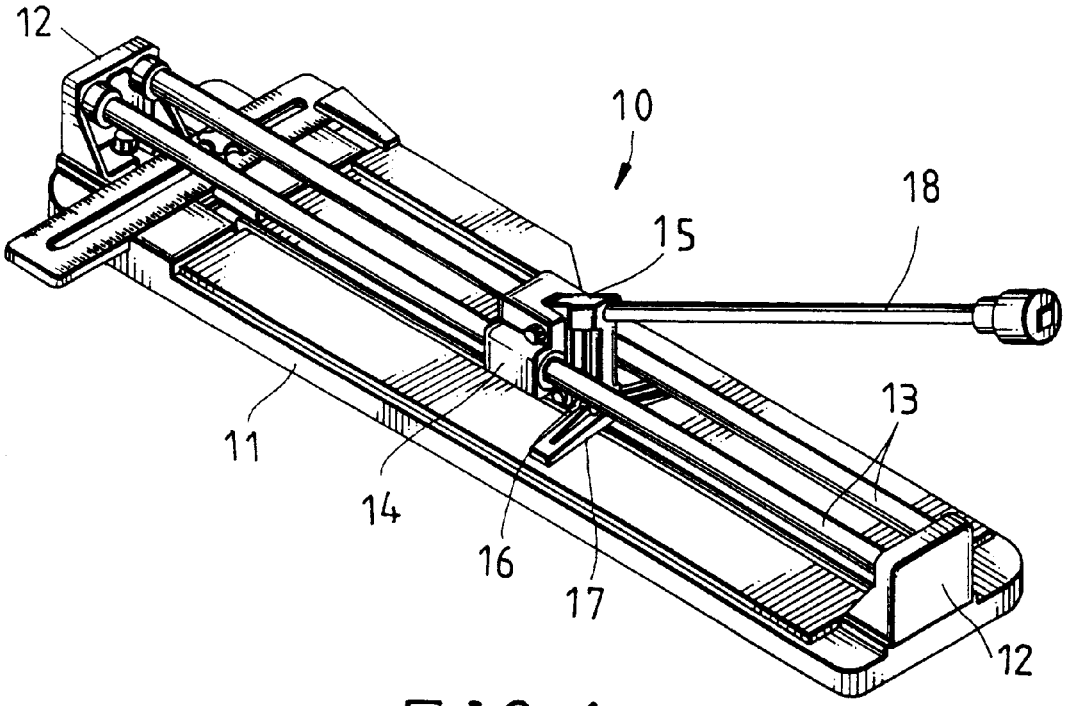
FIG. 1 shows a perspective view of a tile cutter of the prior art.
Figure 2:
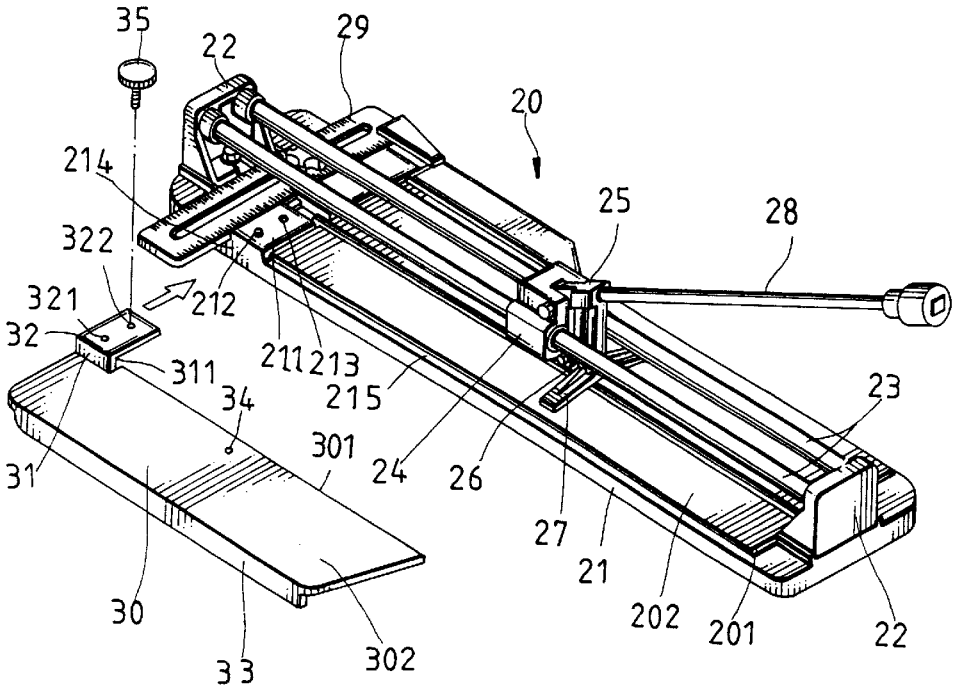
FIG. 2 shows a partial exploded view of a tile cutting device of the present invention.
Figure 3:
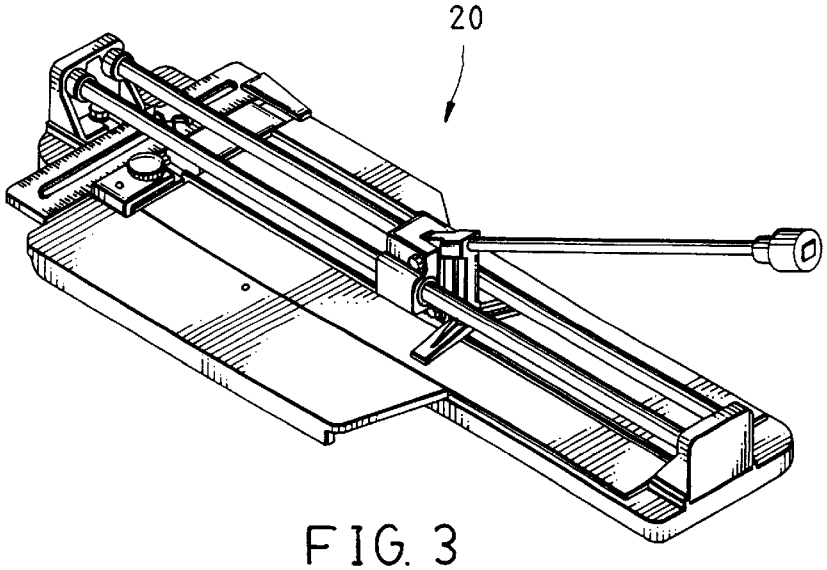
FIG. 3 shows a perspective view of the tile cutting device of the present invention in combination.

As shown in FIGS. 2 and 3, a tile cutting device 20 embodied in the present invention is composed of a rectangular base 21, two support frames 22, two guide rods 23, a slide seat 24, a tile cutting tool seat 25, a circular cutting tool 26, a press plate 27, and a grip rod 28. The tile cutting device 20 is basically similar in construction to the prior art tile cutter, except that the base 21 is provided with a raised surface 211 having a protrusion 212 and a threaded hole 213, and that the base 21 is provided with an auxiliary base 30 which is detachably attached to the base 21.

The base 21 is provided at one end thereof with an auxiliary ruler 29 contiguous to the raised surface 211. The auxiliary base 30 is rectangular in shape and is provided at one end of a longitudinal side thereof with a shoulder 31 extending therefrom such that the shoulder 31 is perpendicular to the upper side of the auxiliary base 30, and that the shoulder 31 is provided with an arm 32 extending therefrom. The arm 32 is perpendicular to the shoulder 31 and is provided with a first through hole 321 and a second through hole 322, which are respectively corresponding in location to the protrusion 212 and the threaded hole 213 of the base 21. The shoulder 31 has an outer side 311, which is not aligned with a longitudinal side 301 of the auxiliary base 30.

The auxiliary base 30 is detachably fastened with the base 21 such that the first through hole 321 of the auxiliary base 30 is engaged with the protrusion 212, and that the outer side 311 of the shoulder 31 is engaged against a side 214 of the base 21, base 21 and the auxiliary base 30 are fastened by a bolt 35 which is engaged with the threaded hole 213 of the base 21 via the second through hole 322 of the arm 32 of the auxiliary base 30. The auxiliary base 30 has another longitudinal side opposite to the longitudinal side 301 and having a rib 33 extending therefrom for reinforcing the structural strength of the auxiliary base 30. The auxiliary base 30 has an upper surface 302, which is flush with a tile placing surface 202 of an elastic pad 201 of the base 21. In other words, the auxiliary base 30 gives an added width to the base 21 so as to accommodate securely a large tile (not shown in the drawings) to be worked on by the tile cutting device 20.

Figure 4:
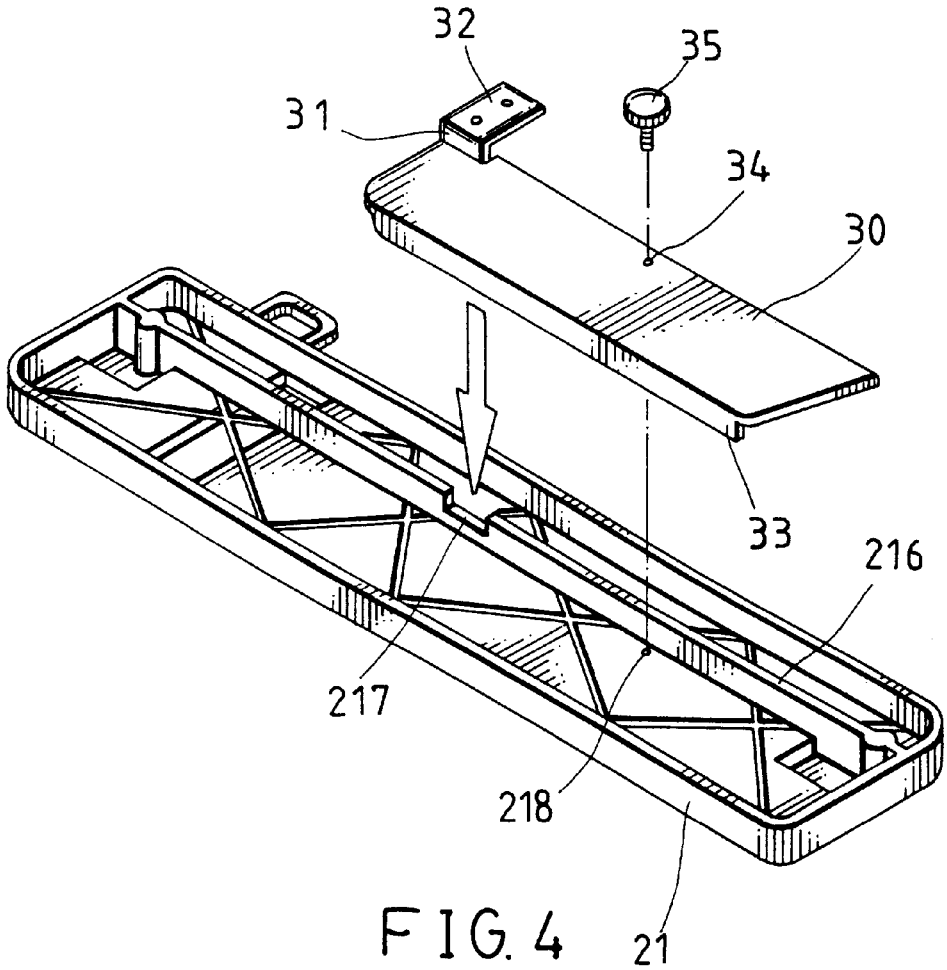
FIG. 4 is a partial exploded view showing an auxiliary base being kept in the underside of a base of the tile cutting device of the present invention.
Figure 5:
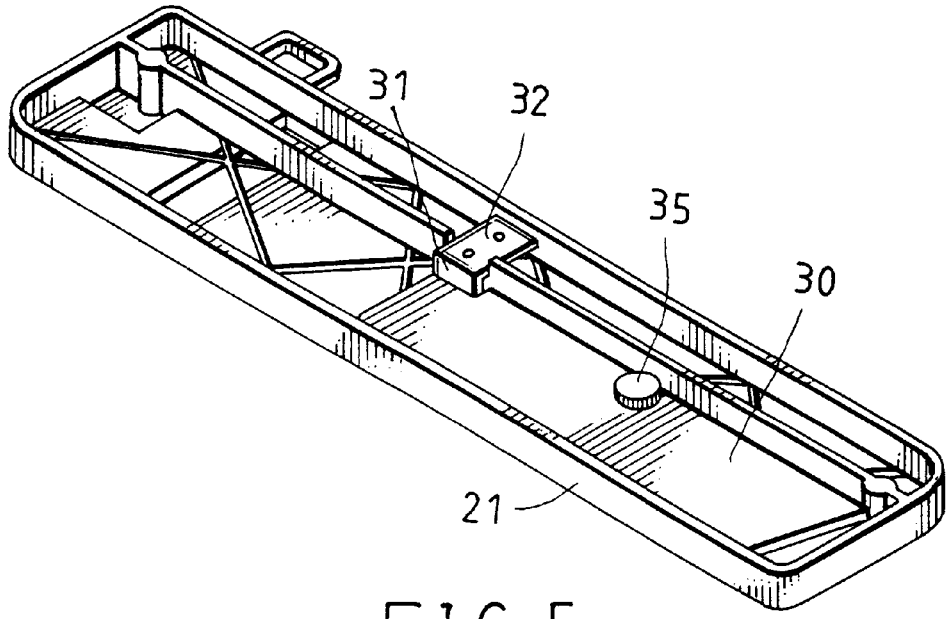
FIG. 5 shows a perspective view of the present invention as shown in FIG. 4.

As illustrated in FIGS. 4 and 5, the auxiliary base 30 can be unfastened with the base 21 by loosening the bolt 35. The base 21 is provided in the underside thereof with a reinforcing rib 216 extending along the direction of the longitudinal axis thereof and having a notch 217. The notch 217 is dimensioned to retain the arm 32 of the auxiliary base 30. The base 21 is further provided in the underside thereof with a threaded blind hole 218 which is engaged with the bolt 35 via a third through hole 34 of the auxiliary base 30. As a result, the auxiliary base 30 is kept securely in the underside of the base 21 when the auxiliary base 30 is not in use.

What is claimed is:

1. A tile cutting device comprising:

a base of a rectangular construction and provided in an upper surface thereof with a tile placing surface;

two support frames mounted on both longitudinal ends of said upper surface of said base;

two guide rods mounted on said two support frames;

a slide seat fastened pivotally with said two guide rods;

a cutting tool seat fastened pivotally with said slide seat;

a circular cutting tool fastened pivotally with said cutting tool seat;

a press plate fastened with said circular cutting tool seat such that said press plate is located behind said cutting tool; and a grip rod fastened with said cutting tool seat for pushing said cutting tool seat to move along said guide rods;

wherein said base is provided at one longitudinal side thereof with an auxiliary base which is detachably fastened therewith such that an upper surface of said auxiliary base is flush with said tile placing surface of said base;

wherein said base is provided in an underside thereof with a threaded blind hole engageable with a bolt; wherein said auxiliary base is provided with a third through hole corresponding in location to said threaded blind hole of said underside of said base; and wherein said auxiliary base is stored in and fastened with said underside of said base when not in operation by said bolt which is engaged with said threaded blind hole of said base via said third through hole of said auxiliary base.

2. The tile cutting device as defined in claim 1, wherein said auxiliary base is of a rectangular construction and is provided at one longitudinal side thereof with an arm extending therefrom and having a first through hole; wherein said base is provided with a threaded hole; and wherein said auxiliary base is detachably fastened with said base by a bolt which is engaged with said threaded hole of said base via said first through hole of said arm of said auxiliary base.

3. The tile cutting device as defined in claim 2, wherein said one longitudinal side of said auxiliary base is provided with a shoulder extending therefrom; wherein said arm of said auxiliary base is extended from said shoulder; and wherein said auxiliary base is fastened with said base such that said shoulder engaged against a side wall of said one longitudinal side of said base.

4. The tile cutting device as defined in claim 2, wherein said base is provided with a protrusion contiguous to said threaded hole of said base; wherein said arm of said auxiliary base is provided with a second through hole; and wherein said auxiliary base is fastened with said base such that said second through hole is engaged with said protrusion of said base.

5. The tile cutting device as defined in claim 3, wherein said shoulder of said auxiliary base is not aligned with said one longitudinal side of said base.

6. The tile cutting device as defined in claim 2, wherein the base has a reinforcing rib with a notch on the underside, said notch retaining the arm of the auxiliary base when said bolt is engaged with said threaded blind hole of said base.

* * * * *